United States Patent [19]

Anderson

[11] 4,018,665

[45] Apr. 19, 1977

[54] RECYCLING AERATED SCAVENGED MIDDLINGS TO CONDITIONING STEP OF HOT WATER EXTRACTION PROCESS

[75] Inventor: Joseph C. Anderson, Fort McMurray, Canada

[73] Assignee: Great Canadian Oil Sands Limited, Toronto, Canada

[22] Filed: July 26, 1976

[21] Appl. No.: 708,790

Related U.S. Application Data

[63] Continuation of Ser. No. 507,823, Sept. 20, 1974, abandoned.

[52] U.S. Cl. ..... 208/11 LE

[51] Int. Cl.[2] ..... G10G 1/04

[58] Field of Search ..... 208/11 LE

[56] References Cited

UNITED STATES PATENTS

| | | | |
|---|---|---|---|
| 2,968,603 | 1/1961 | Coulson | 208/11 LE |
| 3,392,833 | 7/1968 | Baillie | 208/11 LE |
| 3,487,003 | 12/1969 | Baillie et al. | 208/11 LE |
| 3,502,565 | 3/1970 | Baillie | 208/11 LE |
| 3,509,037 | 4/1970 | Tse | 208/11 LE |
| 3,558,469 | 1/1971 | White et al. | 208/11 LE |
| 3,619,406 | 11/1971 | Bowman et al. | 208/11 LE |

*Primary Examiner*—Delbert E. Gantz
*Assistant Examiner*—James W. Hellwege
*Attorney, Agent, or Firm*—J. Edward Hess; Donald R. Johnson

[57] ABSTRACT

In a hot water process for extracting bitumen from tar sands comprising forming a mixture of tar sands and water, settling the mixture in a primary extraction zone to form an upper bitumen froth layer, a middlings layer and a sand tailings layer, passing a part of the middlings layer to an air scavenger zone to recover additional bitumen therefrom, the improvement which comprises adding the aerated bitumen-depleted aerated middlings material from the air scavenger zone to the mixture of tar sands and water before the settling step.

5 Claims, 1 Drawing Figure

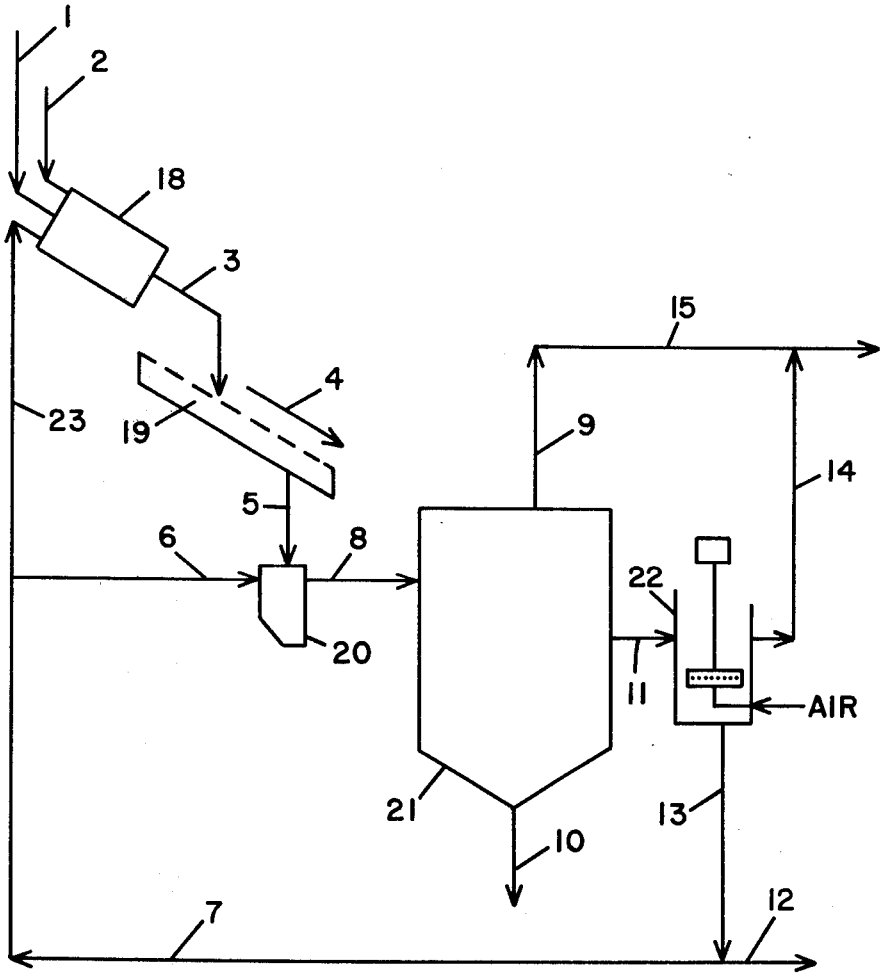
1
2
18
3
15
4
23
19
9
14
5
6
8
22
20
11
AIR
21
13
10
12
7

RECYCLING AERATED SCAVENGED MIDDLINGS TO CONDITIONING STEP OF HOT WATER EXTRACTION PROCESS

This is a continuation of application Ser. No. 507,823, filed Sept. 20, 1974, now abandoned.

BACKGROUND OF THE INVENTION

Tar sands which are also known as oil sands and bituminous sands are siliceous materials which are impregnated with a heavy petroleum. The largest and most important deposits of the sands are the Athabasca sands, found in northern Alberta, Canada. These sands underlay more than 13,000 square miles at a depth of 0 to 2000 feet. Total recoverable reserves after extraction and processing are estimated at more than 300 billion barrels—just equal to the world-wide reserves of conventional oil, 60 percent of which is in the Middle East. By way of contrast, the American Petroleum Institute estimated total United States oil reserves at the end of 1965 at 39.4 billion barrels.

The tar sands are primarily silica, having closely associated therewith an oil film which varies from about 5 percent to 21 percent by weight, with a typical content of 13 weight percent of sand. The oil is quite viscous—6° to 8° API gravity—and contains typically 4.5 percent sulfur and 38 percent aromatics.

The sands contain, in addition to the oil and sand components, clay and silt in quantities of from 1 to 50 weight percent, more usually 10 to 30 percent. The sands also contain a small amount of water, in quantities of 1 to 10 percent by weight, in the form of a capsule around the sand grains.

Several basic extraction methods have been known for many years for the separation of oil from the sands. In the so called "cold water" method, the separation is accomplished by mixing the sands with a solvent capable of dissolving the bitumen constituent. The mixture is then introduced into a large volume of water, water with a surface agent added, or a solution of a neutral salt in water, which salt is capable of acting as an electrolyte. The combined mass is then subjected to a pressure or gravity separation.

In the hot water method, as disclosed in Canadian pat. No. 841,581 issued May 12, 1970 to Floyd et al., the bituminous sands are jetted with steam and mulled with a minor amount of hot water at temperatures of 170° to 190° F., and the resulting pulp is then dropped into a turbulent stream of circulating hot water and carried to a separation cell maintained at a temperature of about 185° F. In the separation cell, sand settles to the bottom as tailings and oil rises to the top in the form of a froth. An aqueous middlings layer comprising clay and silt and about 1 to 5 weight percent bitumen based on the weight of the middlings is formed between these layers. This basic process may be combined with a scavenger step for further treatment of the middlings layer obtained from the primary separation step to recover an additional amount of oil therefrom.

The middlings layer withdrawn from the hot water separation cell in a hot water extraction process contains most of the silt and clay as well as some bitumen. In the hot water extraction process disclosed by Floyd et al. above, a stream of middlings is withdrawn from the primary extraction zone and recycled to the conditioning vessel of the hot water process. Also, a second stream of the middlings is transferred from the primary extraction zone to an air scavenger zone wherein air is bubbled into the material in the scavenger zone to cause flotation of additional bitumen from the middlings material. This bitumen is then recovered as a froth and combined with the bitumen froth recovered from the primary extraction zone. The depleted middlings stream which now contains less bitumen, usually 0.5 to 2.0 weight percent, is normally thereafter discarded into a retention pond or in some circumstances combined with the sand tailings layer which was removed from the primary extraction zone and subsequently discarded.

One of the problems encountered in the above described hot water process is the inefficiency of recovery which sometimes occurs in the primary extraction zone. After the viscosity of the middlings increases, poor flotation is relaized with resulting lower bitumen recovery rates.

The present invention provides an improvement to the above-disclosed hot water extraction process which aids in improving recovery of bitumen from tar sands in a primary extraction zone of a hot water process.

For purposes of definition, in the present disclosure the term "bitumen-rich middlings" defines a middlings material recovered from the gravity settling separation zone of a hot water process for extracting bitumen from tar sands which middlings material is characterized as containing water, silt, clay, and about 1.0 to 5.0 weight percent bitumen. In turn, the term "bitumen-lean middlings" or "bitumen-depleted middlings" defines bitumen-rich middlings which have been treated in an air scavenger zone to extract bitumen and, therefore, result in middlings containing 0.5 to 2.0 weight percent bitumen. In all events, bitumen-lean middlings always contain less bitumen than the bitumen-rich middlings material whence they came.

DESCRIPTION OF THE INVENTION

The present invention relates to a method for improving the recovery of bitumen by the hot water process of recovering bitumen from tar sands. More specifically, the present invention is a method utilizing aerated bitumen-depleted middlings to improve recovery of bitumen in a primary extraction zone. Specifically, the present invention comprises utilizing the bitumen-depleted middlings stream recovered from an air scavenger zone to dilute the tar sands-water mixture prior to separating bitumen from the tar sands in the primary extraction zone of a hot water process for recovering bitumen from tar sands. Bitumen-depleted middlings material recovered from an air scavenger zone of the hot water process contains entrained air bubbles as a result of the scavenger zone aeration. When this aerated stream is added to a tar sands-water mixture prior to separation in a hot water extraction cell, the air bubbles added via the middlings stream aid in flotation of bitumen in the extraction cell thereby improving recovery of bitumen therefrom.

To more clearly illustrate one mode of the method of the present invention, the following drawing is provided. Referring to the drawing, bituminous tar sands are fed into a hot water extraction system through line 1 where they first pass into conditioning zone 18. Water and steam are introduced from line 2 into the conditioning zone and are mixed with the sands. Also, bitumen-depleted middlings material recovered from a hereinafter disclosed air scavener zone 22 is introduced into conditioning zone 18 via line 14 as a part of the water to be added to the tar sands. Total water so introduced is a minor amount based on the weight of the tar sands and generally is in the range of 10 to 45 percent by weight of the mixture. Enough steam is introduced to raise the temperature in the conditioning drum to within the range of 130° to 210° F. and preferably above 170° F. and most preferably about 185° F. Water added into the mixing zone can also be in part a bitumen-rich middlings layer drag stream withdrawn from primary extraction zone 21 and transferred to conditioning vessel 18 by means not shown in this drawing.

An alkaline-containing reagent can also be added to the conditioning zone using the amount of about 0.1 to 3.0 pounds per ton of tar sand. The amount of such alkaline reagent preferably is regulated to maintain the pH of the middlings layer in the separation zone 21 within the range of 7.5 to 9.0 with best results being obtained at a pH value in the range of 8.0 to 8.5. The quantity of alkaline reagent that needs to be added to maintain the pH in the desired range can vary from time to time as the composition of the tar sands obtained from the mine site varies. Alkaline reagents suitable for use include caustic soda, sodium carbonate, or sodium silicate, although any of the other alkaline-containing reagents known in the art for this application can be used if desired.

The mixture from conditioning zone 18 can be transferred via line 3 to screen 19 wherein oversize matter such as rock and tar sand or clay lumps are removed as indicated at 4. The pulp then passes as indicated via line 5 into sump 20 wherein it is diluted with additional water from line 6 which can be recycled bitumen-depleted middlings from scavenger zone 22 which are transferred into line 6 via lines 7 and 13 respectively. A bitumen-rich middlings recycle can also be added to sump 20 from extraction zone 21 by means not shown in this drawing.

The addition of water to the pulp in sump 20 dilutes the pulp to a pumpable viscosity so that it can be easily transferred into separation zone 21 via line 8 as indicated. Additional water can also be added to screen 19 to wash the pulp through the screen and act as the diluent for the pulp. In normal practice, the total amount of water added to the tar sand pulp as liquid water and steam prior to the separation step should be in the range of 0.2 to 3.0 pounds of water per pound of tar sands being processed. The water requirements for the separation zone, of course, are contingent upon the quantity of silt and clay which the tar sands contain as compared to the bitumen content of the tar sands. These conditions are amply described in the prior art.

In separation zone 21, the slurry mixture, if desired, can be agitated by conventional means prior to settling the mixture. When settled, the contents of the separation zone normally separates into an upper bitumen froth layer, a middlings layer containing silt, clay, and bitumen normally in the range of 1 to 5 weight percent of the middlings, and a sand tailings layer. The bitumen froth is recovered from separation zone 21 via line 9. The tailings layer of extraction zone 21 containing sand and some bitumen-rich middlings material is withdrawn via line 10 and discarded to a retention pond. A middlings drag stream is withdrawn from separation zone 21 and transferred via line 11 into air scavenger zone 22. Air is added to scavenger zone 22 as indicated in the drawing. Additional bitumen froth is recovered from zone 22 and is transferred via line 14 into line 15 where it is combined with the primary froth from extraction zone 21 and can be further processed into suitable petroleum products.

A depleted middlings stream comprised substantially of clay, silt, and water with very little bitumen remaining, usually 0.5 to 2.0 weight percent depending on the bitumen content in the drag stream feed and the efficiency of the scavenger zone, is withdrawn from scavenger zone 22 via line 13 and transferred into line 7 which provides the middlings stream to sump 20 via line 6 or to conditioning zone 18 via line 23.

Normal recovery of bitumen from tar sands in the primary extraction zone of the above-defined hot water process lies in the range of 80 to 90 weight percent based on the quantity of bitumen in the tar sands. By the improvement of the present invention, an increase in recovery of bitumen from the primary extraction step in the order of 0.5 to 1.0 percent and above can be realized.

Thus, the present invention provides an improved process for the recovery of bitumen from tar sands comprising the steps:

a. forming a mixture of tar sands and water including that of the hereinafter specified recycle stream of aerated bitumen-depleted middlings material;

b. settling the mixture in a separation zone to form an upper bitumen froth layer, a middlings layer containing water, silt, clay, and bitumen, and a sand tailings layer;

c. separately removing the bitumen froth layer and the sand tailings layer;

d. passing a stream of middlings layer into an air scavenger zone and therein aerating said stream to provide additional bitumen froth;

e. recovering the froth from the scavenger zone and f. removing the bitumen-depleted middlings stream from the air scavenger zone and utilizing at least a part thereof as the aforesaid recycle stream in forming said mixture of step (a).

In essence, the present invention comprises a hot water extraction process for the recovery of bitumen from tar sands including the steps of:

a. forming a mixture of tar sands and water;

b. settling the mixture in a separation zone to form an upper bitumen froth layer, a sand tailings layer, and a middlings layer containing water, silt, clay, and bitumen;

c. separately recovering the bitumen froth layer and the sand tailings layer;

d. passing a stream of middlings to an air scavenger zone and therein aerating said middlings to provide additional bitumen froth;

e. recovering the additional bitumen froth, the improvement which comprises adding at least a part of the bitumen-depleted middlings material to the mixture of step (a).

The invention claimed is:

1. An improved process for the recovery of bitumen from tar sands comprising:

a. forming a mixture of tar sands and water in the ratio of about 0.2 to 3.0 pounds of water per pound of tar sands including that of the hereinafter specified recycle stream of aerated bitumen-depleted middlings material;

b. settling the mixture in a separation zone at a temperature in the range of 130° to 210° F. to form an upper bitumen froth layer, a middlings layer containing water, silt, clay, and bitumen, and a sand tailings layer;

c. separately removing the bitumen froth layer and the sand tailings layer;

d. passing a stream of middlings layer into an air scavenger zone and therein aerating said stream to provide additional bitumen froth;

e. recovering the froth from the scavenger zone; and f. removing the bitumen-depleted middlings stream from the air scavenger zone and utilizing at least some of the aforesaid recycle stream in an, aerated condition, in forming said mixture of step (a).

2. A process according to claim 1 wherein said separation zone is maintained at a temperature of about 185° F.

3. A process according to claim 1 wherein an alkaline reagent is added to the mixture of step (a).

4. A process according to claim 2 wherein an alkaline reagent is added to the mixture of step (a).

5. In a hot water extraction process for the recovery of bitumen from tar sands including the steps of:

a. forming a mixture of tar sands and water;

b. settling the mixture in a separation zone to form an upper bitumen froth layer, a sand tailings layer, and a middlings layer containing water, silt, clay, and bitumen;

c. separately recovering the bitumen froth layer and the sand tailings layer;

d. passing a stream of middlings to an air scavenger zone and therein aerating said middlings to provide additional bitumen froth and an aerated bitumen depleted middlings material stream; and e. recovering the additional bitumen froth;

an improvement which comprises adding at least some of the aerated bitumen-depleted middlings material stream from step (d) in an aerated condition, to the mixture being formed in step (a).

* * * * *